United States Patent [19]

Carter

[11] 4,100,949

[45] Jul. 18, 1978

[54] WEB FORMING APPARATUS

[75] Inventor: Clarence F. Carter, Danville, Ill.

[73] Assignee: Carter Industries, Inc., Danville, Ill.

[21] Appl. No.: 755,632

[22] Filed: Dec. 30, 1976

[51] Int. Cl.[2] ..... B27C 9/04; B27C 5/00

[52] U.S. Cl. ..... 144/3 R; 83/3; 83/417; 83/471.3; 83/477.1; 83/484; 144/39; 144/117 B; 144/130; 144/134 A; 144/242 R; 144/245 R; 144/323; 144/326 R

[58] Field of Search ..... 144/1 R, 2 R, 3 R, 39, 144/134 R, 134 A, 116, 117 B, 242 R, 245 R, 245 D, 326 R, 323, 203, 30, 130; 83/3, 281, 407, 408, 417, 471.3, 471.2, 477.1, 484, 485

[56] References Cited

U.S. PATENT DOCUMENTS

| | | | |
|---|---|---|---|
| 1,606,313 | 11/1926 | Martenet | 144/134 R |
| 1,630,173 | 5/1927 | Dumont | 144/134 R |
| 1,823,200 | 9/1931 | Johnson | 144/3 R |
| 2,170,687 | 8/1939 | Johnson | 144/203 X |
| 2,593,745 | 4/1952 | Gillespie | 144/3 R |
| 2,751,944 | 6/1956 | Stoll et al. | 144/134 R |
| 3,719,216 | 3/1973 | Tracy | 144/30 |
| 3,779,294 | 12/1973 | Gillis | 144/117 B |
| 3,827,325 | 8/1974 | Ward et al. | 83/375 |
| 3,838,722 | 10/1974 | Downing | 144/134 A |
| 3,838,723 | 10/1974 | Sandberg | 83/82 X |

*Primary Examiner*—Othell M. Simpson
*Assistant Examiner*—W. D. Bray
*Attorney, Agent, or Firm*—Burns, Doane, Swecker & Mathis

[57] ABSTRACT

A machine for forming beveled webs, particularly for use in truss structures, includes a feed table upon which a wooden board is placed. A saw is shifted into cutting relation with the board to sever a web which drops into a hopper. A pusher displaces the web from the hopper and along a guide surface and eventually forms a row of webs which is pushed toward a beveling station. At the beveling station, a pair of cutters are situated at opposite sides of the guide surface and each include co-axially arranged router heads. The router heads are of frusto-conical configuration and form a cutting angle through which the webs pass. Top and bottom bevels are cut in the ends of the web by the router heads. The vertex of each cutting angle is spaced from the respective web end to form a flat on the web between the top and bottom bevels. The cutters are mounted for rotary adjustment to vary the inclinations of the router heads, and thus of the bevels being formed. The axis of adjustment lies on a plane bisecting the cutting angle so that the top and bottom bevels will continue to converge toward the center plane of the web.

11 Claims, 8 Drawing Figures

Fig. 5
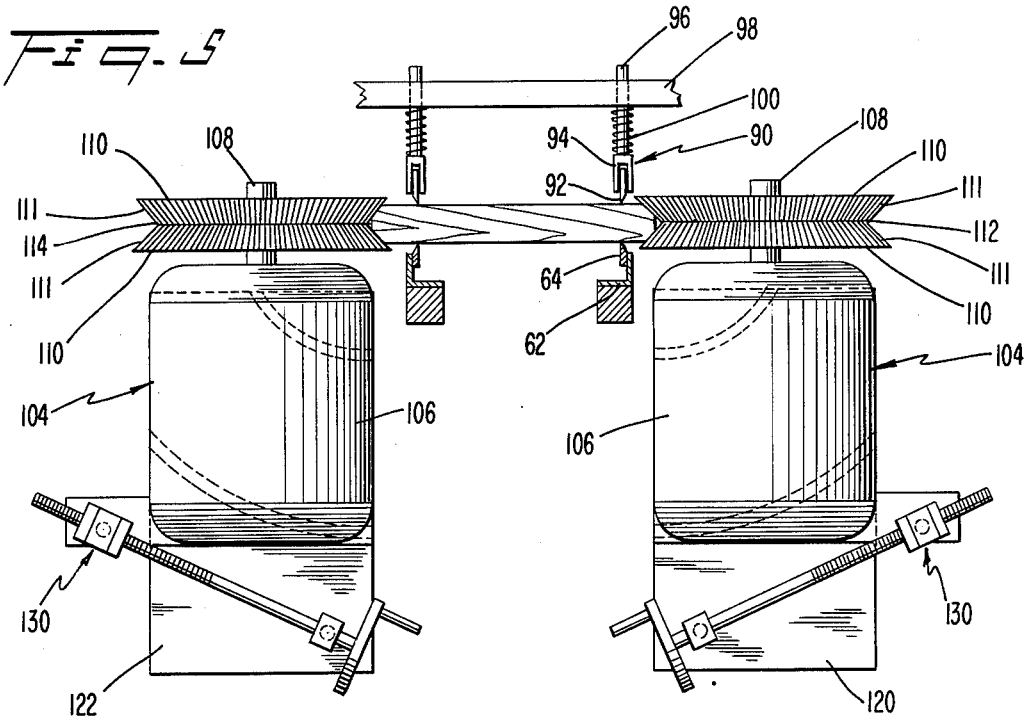
Fig. 5a
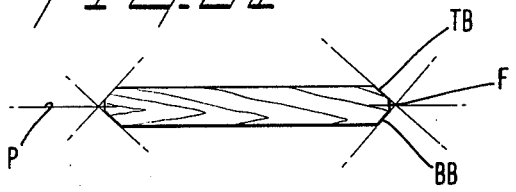
Fig. 6a
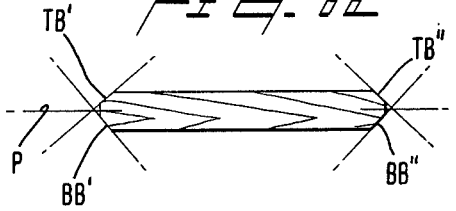
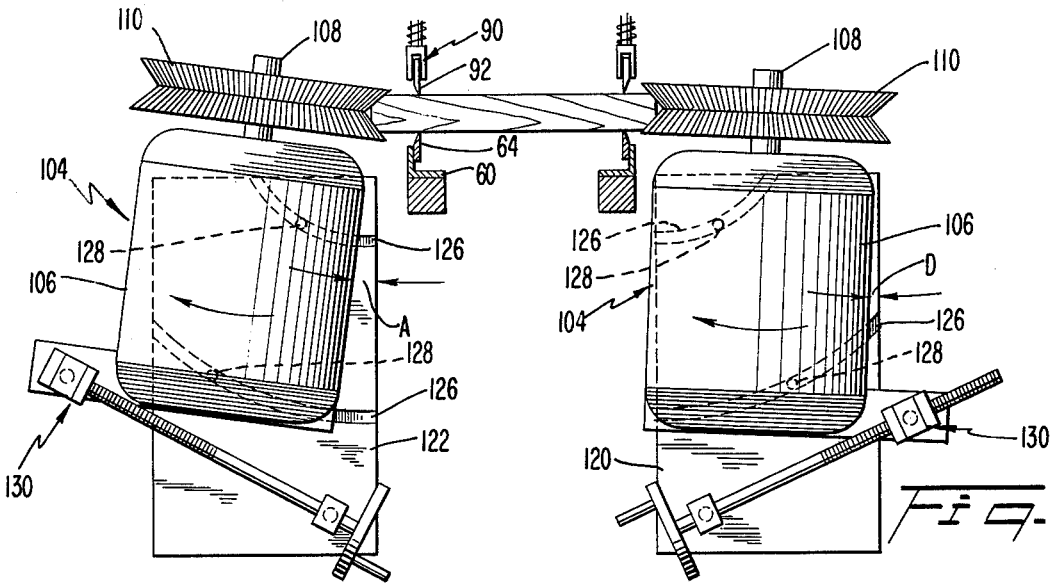
Fig. 6

WEB FORMING APPARATUS

BACKGROUND AND OBJECTS

This invention relates to the cutting of boards and, more particularly, concerns the fabrication of beveled webs for use in truss structures.

The construction of load-supporting walls, floors, and ceilings, etc. of buildings has traditionally involved the formation of wooden truss structures in which relatively long, parallel beams are braced by shorter, diagonally arranged webs. In such an arrangement, the ends of the webs abut surfaces extending at angles other than ninety degrees relative to the longitudinal axis of the web. Accordingly, it is required that the ends of the web are beveled to provide a face-to-face contact with the abutting surfaces when the webs are installed.

Usually, the truss structures are pre-fabricated at a fabricating facility. It is necessary to form the webs by suitably dimensioning a wooden board, such as a two-by-four, for example, and then cutting a pair of angularly disposed bevels at each end of the board.

One known technique for accomplishing this involves cutting boards to proper length by a first saw, placing the cut boards onto a chain conveyor, dragging the boards in spaced fashion through a cutting zone in which a pair of rotary saws at opposite ends of the board cut top and buttom bevels at each end. Each pair of saws are horizontally spaced and are inclined relative to one another. The webs formed in this fashion are then manually removed and inserted into a package.

The overall operation is generally time consuming, requires considerable floor space in the facility, and involves the attention of a number of operators.

Moreover, the effort required to adjust the angles of the beveling saws for various bevel configurations can be complicated and cumbersome. This is especially evident in instances where the bevels of a respective end of a board must be cut at different angles.

The saw orientation of previously proposed machines is such that the bevels intersect to form relatively sharp edges at the ends of the web. Often, this can result in the creation of splinters which, if not removed, can obstruct the proper positioning of the web within the truss structure.

It would be desirable, then, to provide compact, highly automated, and easily adjustable equipment for fabricating beveled webs.

It is, therefore, an object of the present invention to minimize or or alleviate problems of the previously-noted sort.

It is another object of the invention to provide a novel web-cutting machine.

It is a further object of the invention to provide a novel web-cutting machine which is compact, highly automated, and easily adjustable.

It is yet another object of the invention to minimize the man-hours involved in fabricating beveled webs.

It is an additional object of the present invention to minimize the formation of splinters on truss webs.

BRIEF SUMMARY

These and other objects are achieved by the present invention involving a machine which includes a feed table upon which a board is placed. A saw is shifted into cutting relation with the board to sever a web which drops into a hopper. A pusher displaces the web from the hopper and along a guide surface and eventually forms a row of webs which is pushed toward a beveling station. At the beveling station, a pair of cutters are situated at opposite sides of the guide surface and each include co-axially arranged router heads. The router heads are of frusto-conical configuration and form a cutting angle through which the webs pass. Top and bottom bevels are cut in the ends of the web by the router heads. The vertex of each cutting angle is spaced from the respective web end to form a flat on the web between the top and bottom bevels. The cutters are mounted for rotary adjustment to vary the inclination of the router heads, and thus of the bevels being formed. The axis of adjustment lies on a plane bisecting the cutting angle so that the top and bottom bevels will continue to converge toward the center plane of the web.

THE DRAWING

A preferred embodiment of the present invention will be described in detail below in connection with the accompanying drawings in which:

FIG. 5 is a front elevational view of a web beveling section of the web forming machine.

Figure 1:
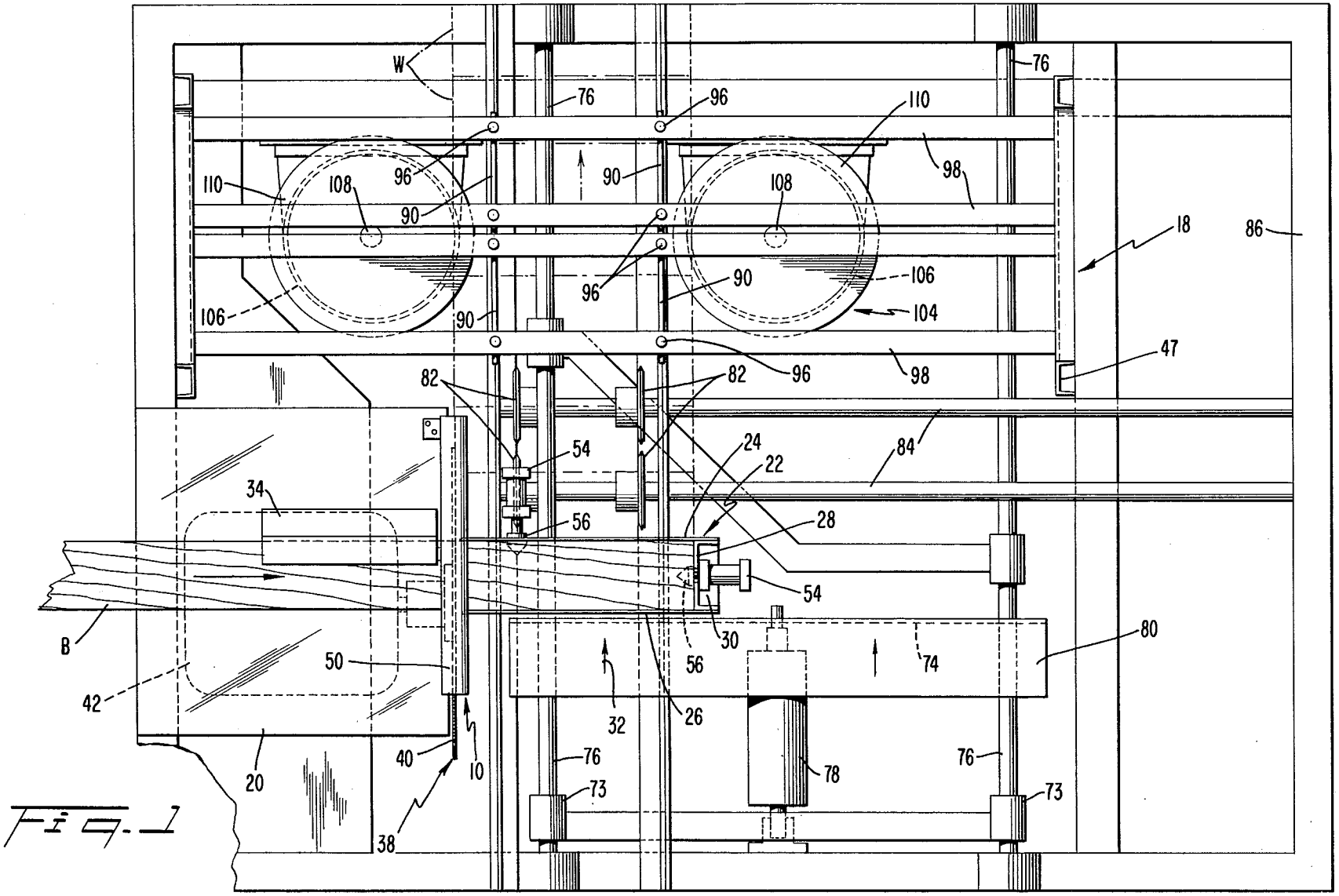
FIG. 1 is a plan view of a web forming machine according to the present invention.

FIG. 5*a* is a front view of a web beveled in accordance with the bevel cutters depicted in FIG. 5;

FIG. 6 is a view similar to FIG. 5 depicting the bevel cutters in adjusted postures; and FIG. 6*a* is a front view of a web beveled in accordance with the adjusted cutters depicted in FIG. 6 wherein the top and bottom bevels at each end of the web are oriented at different angles relative to the center plane of the web.

DETAILED DESCRIPTION OF PREFERRED EMBODIMENT

A machine 10 for forming beveled webs according to the present invention includes a base framework 12 carrying a dimensioning section 14 where wooden boards, such as two-by-fours, are cut to appropriate length, a feed section 16 in which the boards are advanced, and a beveling section 18 where the ends of the boards are beveled.

The dimensioning section 14 comprises a feed table 20 upon which a board is initially placed. When properly positioned, the board extends beyond the table 20 and lies above a hopper 22 disposed adjacent the feed table 20.

The hopper 22 comprises front and rear side walls 24, 26, and an end wall 28. The end wall 28 is spaced from the feed table 20 and is adjustable toward and away from the table. In this connection, the end wall may include a flange 30 that is slidably attached to a rigid portion of the frame 12 by means of a conventional fastener (FIG. 1).

The adjustable wall 28 extends higher than the feed table so that a board can be urged into abutment with the adjustable wall. By altering the location of the adjustable wall, the length of the web to be cut from the board can be selected.

Figure 3:
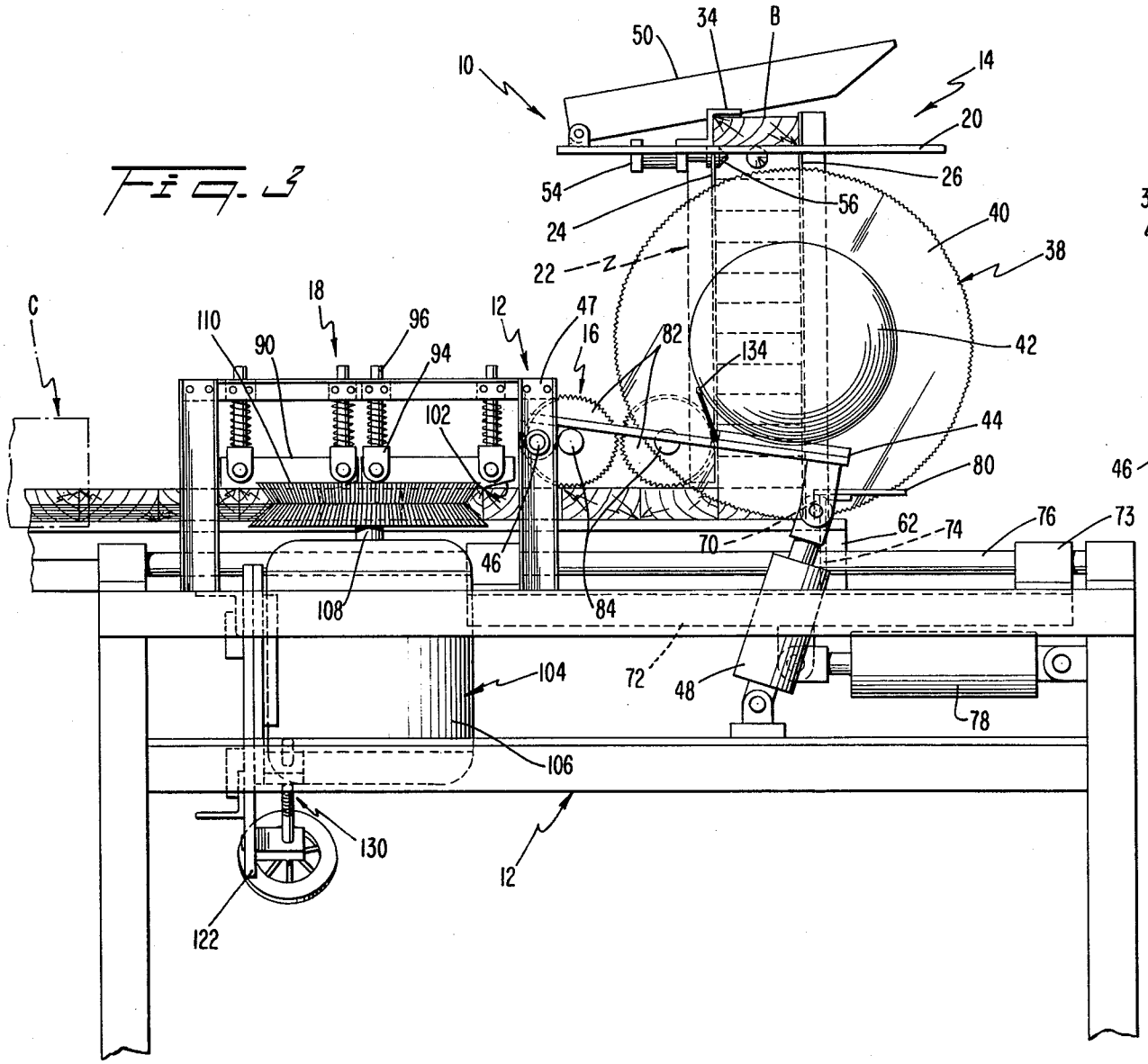
FIG. 3 is a side elevational view of the web forming machine.

Extending across and above a portion of the feed table is a retainer flange 34 which is positioned to lie immediately above the top surface of a board B (FIG. 3). The retainer flange restrains the board against upward movement during an initial cutting step.

This initial cutting step is performed by a cut-off saw 38. The saw 38 includes a vertically oriented rotary saw blade 40 and an electric motor 42 for effecting rotation of the blade 40. The motor 42 is mounted on a plate 44, the latter being connected by a pivot connection 46 at one end to a rigid post 47 of the machine framework for up-and-down swinging movement.

A fluid-actuated piston-cylinder motor, preferably a pneumatic ram 48 is connected between the framework 12 and the other end of the plate 44. Extension of the ram 48 produces upward movement of the cutter blade 40 adjacent the end of the feed table to cross-sectionally sever a board B which is situated on the feed table 20.

Figure 2:
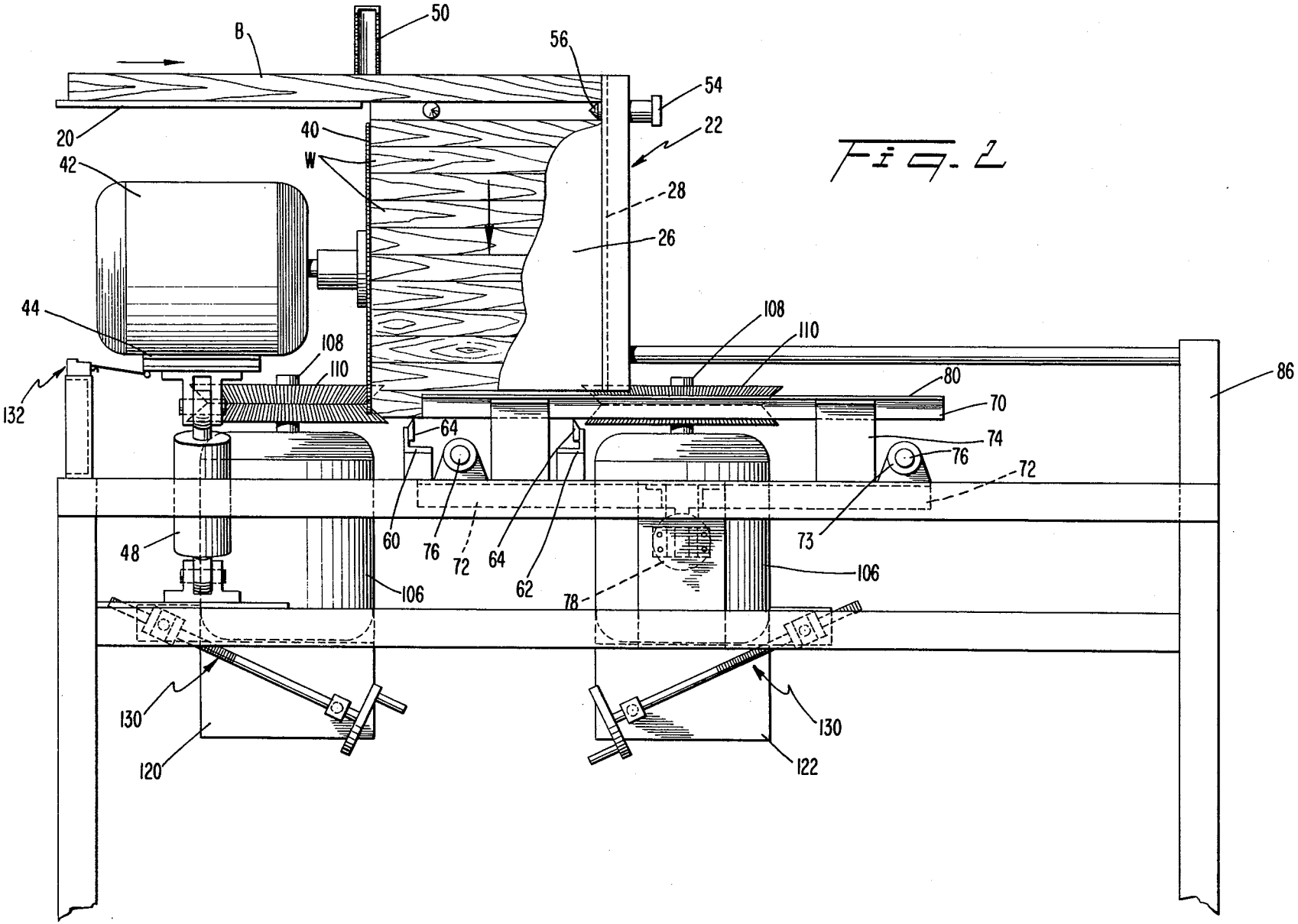
FIG. 2 is a rear elevational view of the web forming machine.

The cutter blade 40 is disposed opposite the adjustable end wall 28 of the hopper 22 and, accordingly, forms the other end wall of the hopper 22 (FIG. 2).

Figure 4:
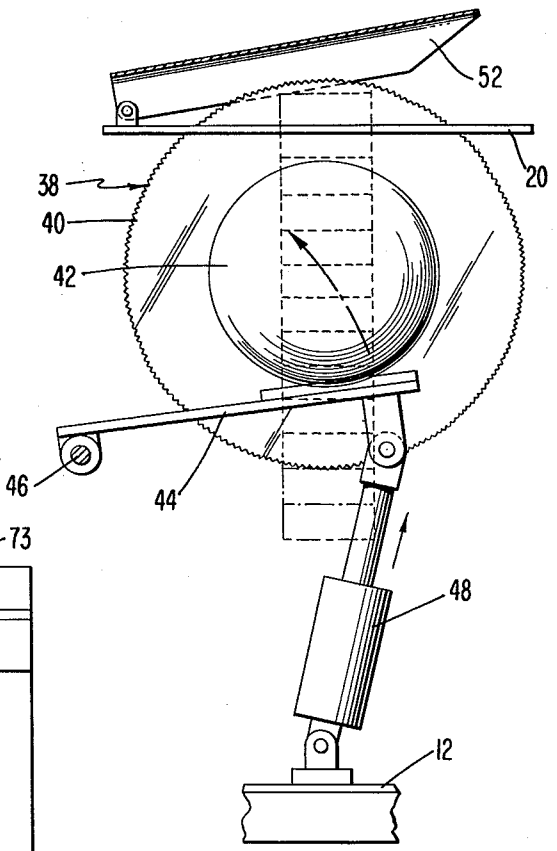
FIG. 4 is a side elevational view of a reciprocable board-severing saw forming a portion of the web forming machine.

A saw guard 50 is mounted over and above the saw blade 40 and includes a recess 52 into which the blade 40 may enter during upward cutting motion (FIG. 4).

Mounted on each of the front side wall 22 and the adjustable end wall 28 is a pneumatic ram 54 which includes an extendable and retractible support pin 56. The pins 56 are reciprocable within openings formed in the front side wall 22 and the adjustable end wall 28. These pins 56 are disposed in extended position, beneath the board, during a cutting step. Accordingly, the web W being cut is supported by the pins until cutting is complete. Thereafter the pins 56 are retracted to allow the web to descend by gravity into the hopper 22.

Mounted on the framework 12 and situated at the bottom of the hopper 22 are a pair of L-shaped, parallel extending guide rails 60, 62 (FIG. 2). One 60 of these guide rails is stationary and the other 62 is adjustable toward and away from the stationary rail 60 to accommodate webs of different lengths. Each rail 60, 62 includes an upstanding leg 64 which has an elongated sharpened edge that engages the bottom surfaces of the webs W. The guide rails 60, 62 extend from beneath the bottom of the hopper 22 and forwardly beyond the beveling section 18 to guide the webs therebetween.

In addition to the hopper 22, the feed section 16 includes an advancing assembly disposed below the hopper 22. The advancing assembly includes a pusher plate 70 which is mounted on a reciprocable pusher carriage 72 by means of brackets 74 (FIGS. 2, 3).

The pusher carriage 72 has sleeves 73 which are slidably mounted on guide bars 76 that are fixed to the machine framework 12. A pneumatic pusher ram 78 is connected between the machine framework and the pusher carriage 72 to reciprocate the latter and the pusher plate 70, so that the pusher plate advances the lowermost web W in the hopper 22 by a distance equal to the web width. The pusher plate includes a horizontal flange 80 which underlies the hopper 22 when the pusher plate is advanced so as to support the next web in the hopper. When the pusher plate returns to its initial position, that next web drops onto the guide rails 60, 62. Eventually, a row of webs W is formed on the guide rails 60, 62 and is sequentially advanced an incremental amount during each forward stroke of the pusher plate 70.

Mounted on the framework 12 for rotary movement above the webs W are pairs of laterally spaced, hold-down sprocket wheels 82. These wheels 82 are mounted for free rotary movement about parallel axes formed by axles 84 that are rotatably mounted in a bearing support 86 on the framework. The hold-down sprockets include pointed teeth which engage the top surfaces of the advancing webs. Adjustment of the hold-down sprockets along the axle is possible by loosening a clamping screw which secures the sprockets to the axle.

Disposed forwardly of the hold-down sprockets 82 are laterally spaced pairs of hold-down arms 90 (FIGS. 2, 5). The hold-down arms 90 include pointed plates 92 which are mounted in spring loaded yokes 94. These yokes include rods 96 which are slidably mounted within supports 98 that are fixedly carried by the machine framework. A coil spring 100 is disposed between the support 98 and the yoke 94 to bias the pointed arm 94 downwardly against the top surfaces of the webs W. The ends 102 of the plates facing the oncoming webs are beveled to facilitate movement of the webs thereunder (FIG. 3). If desired, arms 90 can be made laterally adjustable to accommodate webs of different length.

Located on opposite sides of the hold-down arms 90 are a pair of bevel cutters or dado cutters 104. These cutters each comprise an electric motor 106, an output shaft 108, and a pair of co-axial router heads 110 mounted side-by-side in co-axial fashion on the shaft. The router heads 110 are each of frusto-concial configuration and include cutting surfaces 111 arranged in reverse orientation to form a V-shaped cutting grove 112 of ninety degrees therebetween. The V-groove 112 includes a vertex 114 defined by the intersection of the bladed cutter surfaces 111 of each pair of router heads 110. The vertex can be real or imaginary (as in the case where the surfaces 111 do not physically intersect). This vertex is arranged to lie essentially on a horizontal center plane P disposed parallel to upper and lower surfaces of the board and containing the midpoint of the web W.

As a web travels between the cutters 104, the router heads cut top and bottom bevels TB, BB at each end of the web.

The motors 106 are mounted on supports 120, 122, one 122 of which being adjustable toward and away from the other to accommodate webs of different lengths.

The cutters 104 are spaced such that a web W passing therebetween will not extend completely from one vertex 114 to the other. Rather, the vertices 114 are spaced from the ends of the web so that the resulting bevels do not intersect. That is, a flat portion F is formed between the upper and lower bevels. Preferably, this flat F is from $\frac{1}{4}$ to $\frac{1}{2}$ inches in width. It has been found that this expedient avoids the formation of splinters which might tend to prevent the web from fitting flush against its contact surfaces in a truss structure.

The motors 106 are mounted for rotational adjustment relative to their respective supports 120, 122 to vary the orientation of the router heads 110 and thus vary the inclination of the bevels produced thereby. Importantly, the arrangement is such that the axis of rotation for such rotary adjustment assures that the top and bottom bevels will remain on respective sides of the center plane of the web, i.e., the horizontal plane disposed parallel to and midway between the top and bottom web faces.

In this regard, the axis of rotation lies essentially on the center plane of the web, preferably bisecting the angle 112 and passing through the vertex 114 of the cutting angle 112 and extending parallel to the direction of the web travel. If desired, the rotary axis of adjustment could lie at other locations on the center plane, such as at the flat F. In this manner, it is assured that the top and bottom bevels cut by the respective router heads will remain on respective sides of the center plane of the web.

Such an adjustment can be accomplished in numerous ways. Preferably, the motor supports 120, 122 each include a pair of slots 126 which are each in the form of a segment of a circle whose center lies essentially at the vertex 114 of the router heads 110. The motors 106 each include projections or keys 128 which are received in these slots. A manually actuable turnbuckle mechanism 130 is operably connected between each support 120, 122 and its respective motor 106. Actuation of the turnbuckle produces rotation of the motor in a direction defined by the key-slot arrangement, viz., about the vertex.

The machine 10 is highly adaptive to automatic operation. For example, when an operator has positioned a board in proper cutting position on the feed table, he activates a switch which produces an extension and retraction cycle of the pneumatic ram 48 to produce a severing of the board. Return of the motor-carrying plate 44 to its lower position activates a first limit switch 132 (FIG. 2) to initiate a retraction-extension cycle of the support pins 56, allowing the web to drop into the hopper 22. As soon as the first web enters the hopper 22, it activates a second limit switch 134 (FIG. 3) to begin a continuous extension-retraction cycling of the pusher ram 78. The pusher plate 70 is continuously reciprocated as long as a web is situated in the hopper. Eventually, a stack of webs accumulates in the hopper assuring that reciprocation of the pusher plate will be continuous.

Continued cutting of webs and reciprocation of the pusher plate 70 produces a row of webs traveling along the guide rails 60, 62 and passing through the router heads 110. A container C (FIG. 3), is positioned at the end of the guide rails such that its cavity is aligned with the direction of travel of the webs. In this fashion, the webs will be automatically pushed into the container until the latter has been filled. The machine operator can then replace the box while operation of the machine proceeds. A single operator will be able to operate the machine.

OPERATION

An operator positions a board B upon the feed table 20 such that it lies beneath the flange 34 and engages the end wall 28 of the hopper 22. By activating a suitable switch, the ram 48 is cycled to produce an upward movement of the saw blade 40 through the board. Subsequent return of the saw 38 to its lower position produces actuation of the first limit switch 132 to retract the support pins 56, enabling the cut web W to enter the inlet end of the hopper 22. The first web entering the hopper actuates the second limit switch 134 to begin continuous cycling of the ram 78 and thus continuous reciprocation of the pusher plate 70.

During its forward stroke, the pusher plate advances the web along the guide rails 60, 62. Any subsequently-cut webs in the hopper are supported by the flange 80 on the pusher plate until the pusher plate 70 completes a rearward stroke. The next web W in the hopper then drops onto the guide rails 60, 62. Eventually, a stack of webs W accumulates in the hopper and a row of webs forms on the guide rails. As they are being sequentially advanced along the guide rails by an incremental amount by the pusher plate 70, the webs are maintained in proper position by the hold-down sprocket wheels 82 and the hold-down arms 90.

The router heads 110 of one cutter 104 are spaced from those of the other to assure that a flat F is formed between the top and bottom bevels TB, BB, to minimize the formation of splinters. Orientation of the web W horizontally midway between the cutters 104 is facilitated by the pointed edges of the guide rails 60, 62, and the hold-down wheels and arms 82, 90 which bear against the webs and resist lateral movement.

The blades of the router heads 110 (FIG. 5) cut top and bottom bevels TB and BB in the web to produce a beveled web wherein the bevels TB, BB at a respective end of the web are oriented at equal angles relative to a center plane which passes through the center of the web and lies parallel to top and bottom surfaces of the web (FIG. 5*a*). Moreover, these bevels converge toward an imaginary intersection line which lies on that plane, although terminating short thereof to form the flat F.

In some truss arrangements, it may be necessary to adjust the bevel inclination such that the bevels at one (or both) of the web ends are disposed at mutually different angles. The present invention enables this to be accomplished in a manner wherein the bevels continue to be convergent toward a center plane of the web. This is due to the adjusting arrangement wherein the bevel cutters 104 pivot about an axis defined essentially along the vertex 114 of the groove 112 between the router heads 110. For example, in FIG. 6 one of the cutters 104 (at the left of the figure) has been displaced from its position shown in FIG. 5 by an angle A, and the other cutter 104 (at the right of the figure) has been displaced by a smaller angle D. A web produced by this adjusted arrangement is illustrated in FIG. 6*a* wherein the top bevel TB′ at one web end is inclined at a smaller angle relative to the center plane of the web than the adjacent bottom bevel BB′. At the other web end, the converse is the case wherein the top bevel TB″ is disposed at a larger angle relative to the center plane than its adjacent bottom bevel BB″. In both cases, however, i.e., at both web ends, the bevels converge toward (but short of) the center plane.

As soon as webs have been beveled, they continue to advance into the container C. When the container is full, the operator replaces it.

By virtue of the present invention, the high-speed formation of high-quality webs is made possible. The machine 10 is efficient in that only three cutter motors 42, 106 and an air-actuated pusher motor 78 are required. A single operator can function to feed boards to the machine and insert and remove filled boxes of webs intermittently as automatic operation of the machine proceeds. The machine is compact and easily adapts to small space requirements.

The webs which are produced by the web cutting machine according to the present invention are configured for maximum utility. The creation of the flat F reduces the unwanted formation of splinters which can interfere with proper alignment of the web in the truss structure.

Adjustment of the cutters to vary the bevel inclination is simple with only two adjustment members requiring actuation. Moreover, the productions of webs wherein the bevels at a respective web end lie at different inclinations is most effective since the unique adjustment feature of the present invention assures that the resulting bevels will still converge essentially toward the center plane of the web. This facilitates proper positioning of the web in the truss structure. In addition, the fixed angular relationship between the cutting surfaces 111 assures that the cutting groove 112 will always be ninety degrees despite adjustment of the motors 106.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. A machine for forming beveled webs comprising:

a table for receiving a board to be cut;

a vertical hopper having an upwardly open inlet end adjacent said table;

a first power driven cutter disposed adjacent said table;

means for shifting said first cutter toward and away from cutting engagement with a board on said table, such that a portion of said board lying above said hopper is severed from the remainder of said board to form a web suitable for entry into said hopper;

support means located beneath said hopper for receiving and supporting said web;

a pair of bevel cutters situated at opposite sides of said support means, each bevel cutter comprising a pair of co-axially arranged, power-driven router heads having inclined cutting faces, forming a cutting angle therebetween, for cutting top and bottom bevels in each end of the web;

pusher means located adjacent the bottom of said hopper; and means for driving said pusher means alternately forwardly and rearwardly to displace webs from said hopper and form a row of webs on said support means and to advance the webs an incremental distance toward engagement with said bevel cutters during each forward stroke.

2. A machine according to claim 1 wherein said first cutter comprises a vertically oriented rotary saw mounted for up and down movement toward the board.

3. A machine according to claim 2 wherein said blade is arranged to define an end wall of said hopper.

4. A machine according to claim 1 wherein said pusher means comprises a plate which is mounted for reciprocable movement; the forward stroke of said pusher being such as to advance the row of webs by a distance substantially equal to the width of a web.

5. A machine according to claim 4 wherein said pusher means includes a fluid ram operably connected to said plate; switch means being provided for sensing a web in said hopper and for actuating said fluid ram in response to the sensing of a web in the hopper.

6. A machine according to claim 5 including a plurality of fluid driven reciprocable support pins situated at the inlet of said hopper to support a web; said pins being automatically retractable following a cutting stroke by said first cutter to allow the web to drop into said hopper.

7. A machine according to claim 1 wherein said support means comprises a plurality of laterally spaced guide rails having pointed upper edges for supporting said webs.

8. A machine according to claim 1 wherein said cutters each include a motor mounted for pivotal movement about an axis extending substantially through the vertex of said cutting angle.

9. A machine according to claim 1 further including hold-down means disposed above said support means to bear downwardly against webs traveling toward said bevel cutters.

10. A machine according to claim 9 wherein said hold-down means includes freely rotatable sprocket wheels having pointed projections.

11. A machine according to claim 9 wherein said hold-down means includes arms having pointed bottom edges and spring means yieldably biasing said arms downwardly.

* * * * *